US005308229A

United States Patent [19]

DuPuis et al.

[11] Patent Number: 5,308,229

[45] Date of Patent: May 3, 1994

[54] PUMP HAVING AN INTERNAL GAS PUMP

[75] Inventors: Francis A. DuPuis, Lebanon; Ali M. Nasr, Summit, both of N.J.

[73] Assignee: PMC Liquiflo Equipment Company, Warren, N.J.

[21] Appl. No.: 978,629

[22] Filed: Nov. 19, 1992

Related U.S. Application Data

[63] Continuation-in-part of Ser. No. 892,752, Jun. 3, 1992, abandoned.

[51] Int. Cl.[5] ..... F04D 13/14

[52] U.S. Cl. ..... 417/368; 417/370; 417/372; 417/420

[58] Field of Search ..... 417/368, 370, 372, 420

[56] References Cited

U.S. PATENT DOCUMENTS

| | | | |
|---|---|---|---|
| 3,513,942 | 5/1970 | Sato | 417/420 |
| 4,812,108 | 3/1989 | Kotera | 417/368 |
| 4,990,055 | 2/1991 | Korenblit | 415/144 |

*Primary Examiner*—Richard A. Bertsch
*Assistant Examiner*—David W. Scheuermann
*Attorney, Agent, or Firm*—Paul J. Cook

[57] ABSTRACT

Pump apparatus having a wear end and a pump end is provided with means for preventing liquid being pumped from entering the wear end. An internal pump is positioned between the wear end and the pump end of sealless pumps to direct small quantities of gas from the wear end to the pump end at a pressure which prevents liquid in the pump end to pass into the wear end.

16 Claims, 4 Drawing Sheets

PUMP HAVING AN INTERNAL GAS PUMP

REFERENCE TO RELATED APPLICATION

This application is a continuation-in-part of application Ser. No. 07/892,752, filed Jun. 3, 1992, now abandoned.

BACKGROUND OF THE INVENTION

This invention relates to a pumping apparatus having a wear end and a pump end having an internal pumping means to prevent liquid in the pump end from entering the wear end. More particularly, this invention relates to a sealless pumping apparatus having a pump end and a wear end wherein a rotor portion of the wear end is sealed from a stator portion of the wear end and wherein an internal pumping means is provided to prevent liquid in the pump end from entering the wear end.

Pumps generally include a pump end where incoming liquid is pressurized for subsequent recovery through an outlet and a wear end where the parts subject to wear such as bearings, shaft, thrust washers, driven magnet or the like are located. Pumps of all types, including centrifugal, gear or screw pumps rely on a seal or a magnetic drive or a canned motor design in order to minimize leakage from the pump. The relatively simple designs of the sealed pumps have a seal which will wear and, therefore, eventually leak.

In canned motor design pumps and magnetic drive pumps, the rotating portion inside the pump is separated and sealed from the stator portion of the pump or the drive magnet portion respectively by means of a seal known as a can, lining or shell. The can prevents fluid in the rotor portion from contacting the stator portion of the wear end. Since a rotating shaft does not rotate through the can, there is no need to provide a seal between the can and rotor portion of the pump. The can portion of the pump is formed of a metallic or plastic composition to render it resistant to a variety of liquids being pumped, particularly hydrocarbon compositions. However, the type of liquids that can be pumped also is limited such as acidic compositions which degrade the can metallic composition, slurries, the solid portion of which rapidly deteriorate the wear end and hot liquid composition which also deteriorate the wear end. In the case of slurries, it has been proposed to utilize a screen or a filter between the pump end and the wear end to eliminate contact between the solid portion of the slurry and the wear end. The use of filter screens is undesirable since they become rapidly plugged thereby depleting the wear end of needed heat exchange and lubricating liquid. In addition, in magnetic drive pumps, the use of metallic cans creates eddy current losses which produce undesirable heat that must be removed from the wear end. In addition, since presently available canned motor pumps and magnetic drive pumps rely upon the liquid being pumped to effect lubrication and heat removal in the wear end, they cannot be run dry accidently without destroying the pump. With either of the magnetic drive or canned motor sealless pump designs, the units do not have seals but they do have internal bearings and thrust washers and shafts which depend on the fluid being pumped for lubrication. Accordingly, these parts will wear over time as well. In the event that the liquid being pumped is non-lubricating, abrasive or crystalline or very hot or cold, the bearings, washers and shafts can be damaged quickly and render the pumps either too expensive or impractical to repair.

When utilizing a liquid in the wear end for lubrication, antifriction bearings such as roller bearings or ball bearings cannot be used. Generally, sleeve bearings are used which are of higher cost and have less predictable life than antifriction bearings.

U.S. Pat. No. 4,290,611 discloses a pumping seal utilizing a plate having spiral grooves as a pump. U.S. Pat. No. 5,090,712 discloses a pumping seal having an alternative discontinuous grooved surface.

Accordingly, it would be desirable to provide a pump which prevents liquid being pumped from entering a wear end of a pump. This will allow the use of the pump in slurries, low viscosity or thin liquids, high temperatures, afford "run dry" protection and greatly extend the life of the wear end. It would also be desirable to provide a magnetic drive pump which can utilize a nonmetallic can in order to avoid eddy current loss.

In addition, it would be desirable to avoid liquid in the wear end to permit use of antifriction bearings and to provide more sensitive detection of unwanted liquid in the wear end but removes the negative aspects of the nonmetallic can being the only seal to the environment.

SUMMARY OF THE INVENTION

In accordance with this invention, a pump apparatus is provided having a pump end and a wear end wherein liquid in the pump end is prevented from entering the wear end by use of an internal pump positioned between the pump end and the wear end. Apparatus in the wear end includes a rotor means for including a rotatable shaft and a stator wherein the rotor and stator are sealed from each other by a can structure. The pump end includes pumping means such as an impeller mounted on the same rotatable shaft when rotating. The internal pump directs small quantities of pressurized or non-pressurized gas from the wear end to the pump end while preventing the passage of liquid from the pump end into the wear end. When idle, the device prevents flow from the pump end into the wear end by forming a seal. Thus, the internal pump eliminates the problems associated with non-lubricating fluids, dry running mishaps, and the pumping of slurries with sealless pumps. In addition, it eliminates the corrosive or deteriorating affect of the liquid being pumped by the pump apparatus in the wear end. The pumps of this invention differ from prior art sealless pumps which do not include a sealing means or pump means between the wear end and the pump end. In addition, the pumps of this invention differ from prior art sealless pumps in that liquid is excluded from the wear end.

DESCRIPTION OF SPECIFIC EMBODIMENTS

The present invention provides a pump apparatus for preventing leakage from a sealless rotating pump. The sealless rotating pump is a canned motor pump or a magnetic drive pump. The pump apparatus of this invention comprises a pump end, a wear end and an internal pump positioned between the pump end and the wear end. The pump end includes a pumping means positioned on a rotatable shaft which effects an increase in liquid pressure in the pump end when the shaft is rotated. The pump means can be an impeller, a set of meshing gears used in a gear pump, screws, vanes, flexible impeller or the like. Conventional shaft supporting means on the wear end include bearings, thrust washers, magnetic bearings, antifriction bearings, e.g., roller bearings or ball bearings, or the like. The wear end is supplied with a lubricating gas, preferably air, which is passed through the wear end during use of the pump. An internal pump is positioned on the rotatable shaft between the pump end and the wear end and functions to pump small quantities of lubricating gas from the wear end to the pump end while preventing passage of liquid from the pump end to the wear end when rotating. It functions as a seal when idle. A stator portion of the wear end is separated from a rotor portion of the wear end by means of a seal commonly referred to in the art as a can or shell. Cooling passages can be provided through the stationary housing such as a dual can for the pump for heat exchange liquid such as water to remove heat generated.

A suitable internal pump comprises a stationary ring mounted on a stationary section of a housing for the pump. The stationary ring is positioned to surround the rotatable shaft. A rotatable ring having a face which provides pumping and sealing is mounted on the rotatable shaft between the pump end and the wear end. The rotating ring can be mounted directly on the shaft or indirectly on the shaft by being mounted on an impeller or on a second rotatable ring or the like which, in turn, is mounted on the shaft. The surface of the rotatable ring having the pattern contacts the face of the stationary ring. A pattern or inclined surface on either the rotatable ring or the stationary ring provides fluid communication between the wear end and the pump end when the rotatable shaft is rotated and is configured to increase the pressure of the lubricating gas in the wear end and to effect passage of small quantities of gas from the wear end into the pump end. Since lubricating gas is pumped into the pump end, passage of liquid from the pump end into the wear end is prevented. When the rotatable shaft is stationary, the stationary ring and the rotatable ring contact each other to form a seal which prevents liquid flow from the pump end to the wear end.

Figure 1:
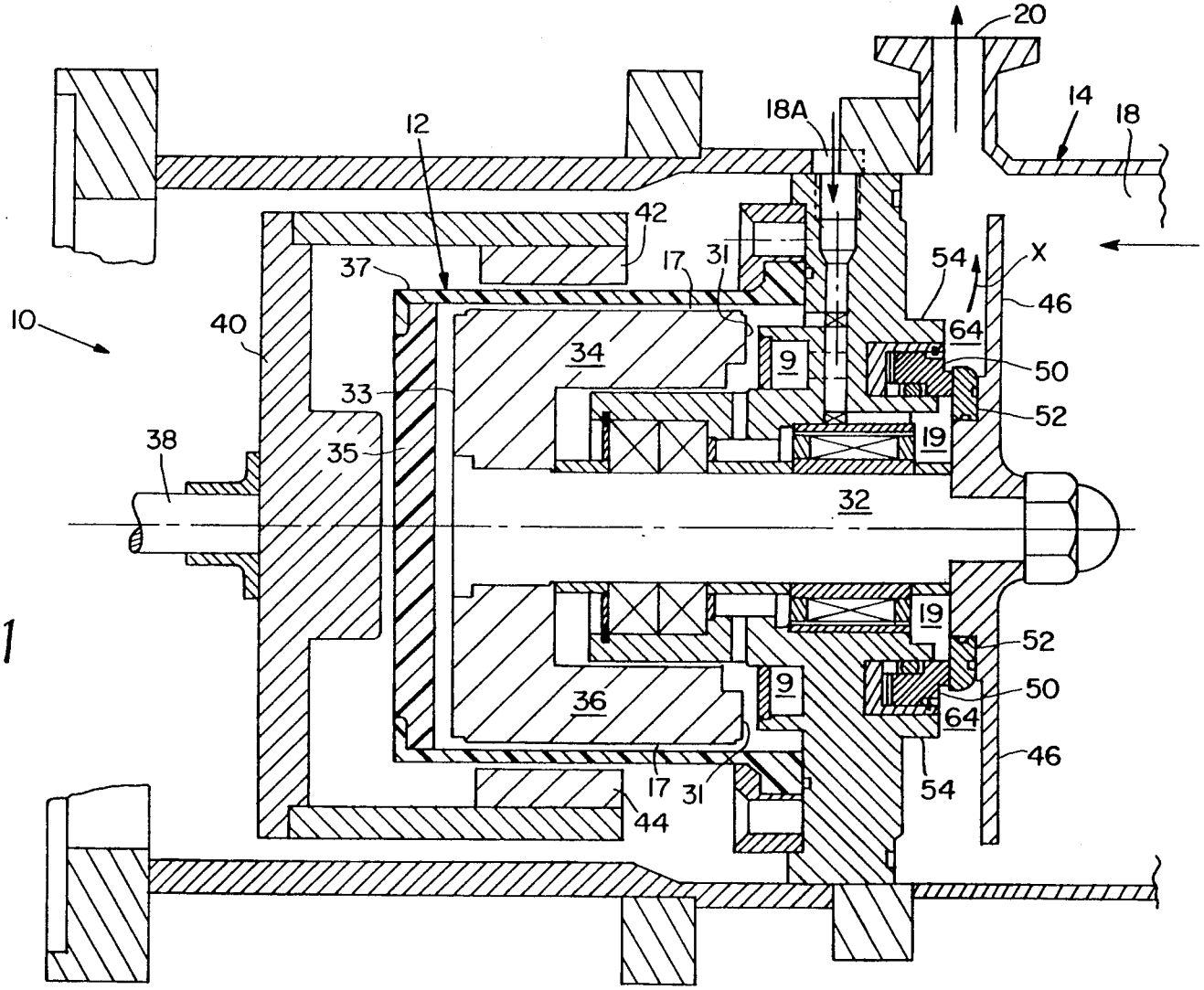
FIG. 1 is a side view in partial cross-section of an embodiment of this invention.
Figure 1A:
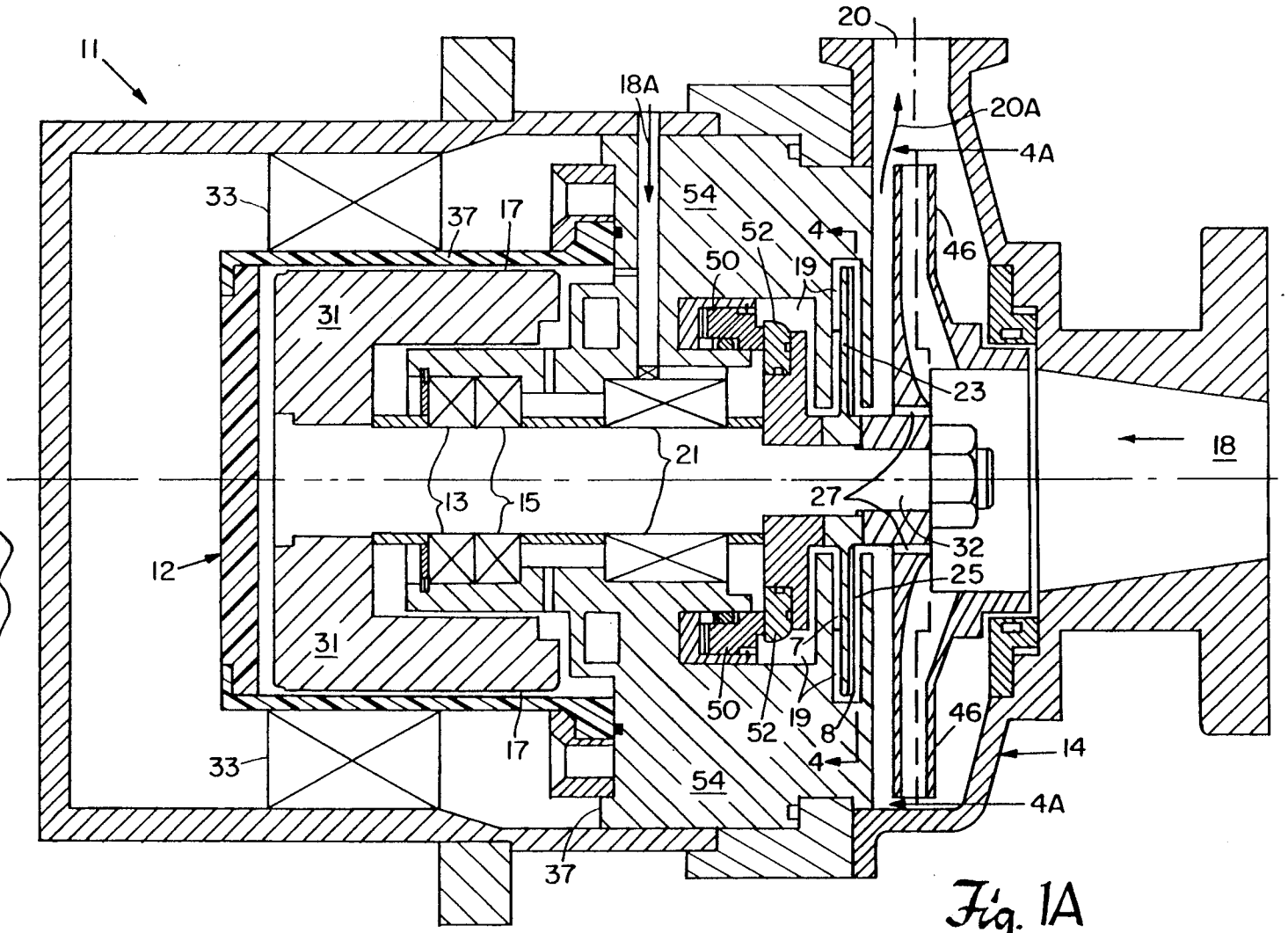
FIG. 1A is a side view in partial cross-section of an alternative embodiment of this invention.
Figure 2:
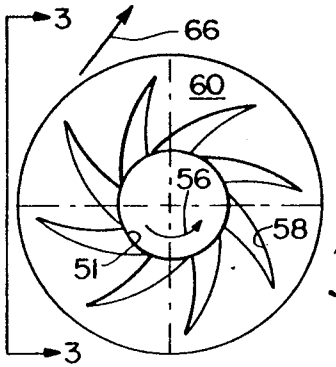
FIG. 2 is a front view of the internal pump shown in FIGS. 1 and 1A.
Figure 3:
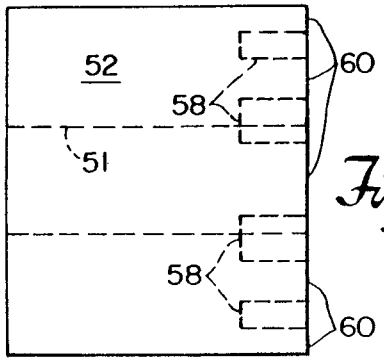
FIG. 3 is a side view of the internal pump of FIG. 2 taken along line 3—3.

Referring to FIGS. 1-3, pump 10 includes a stationary housing formed of a wear end housing section 12 and a pump end housing section 14 which are joined together by bolts. The pump 10 includes a liquid inlet 18 and a liquid outlet 20. The pump 10 comprises a rotatable shaft 32 to which is attached a plurality of magnets including magnets 34 and 36. The shaft 32 is positioned within stationary housing 35 includes an outer wall 37. The outer wall 37 seals the annular space 17 and magnets 34 and 36 from the rotating magnets 42 and 44. A drive shaft 38 is secured to rotatable housing 40 to which are attached magnets 42 and 44. The stationary housing 35 includes an inlet 18A and an outlet X so that gas can be pumped through annular spaces 17 and 19 which gas is sealed from contact with the rotating magnets 42 and 44 by wall or can 37. When the rotatable housing 40 is rotated, the flux fields of magnets 42 and 44 interact with the flux fields of magnets 34 and 36 whether configured as permanent magnet drive or an eddy current drive and thereby cause rotable shaft 32 to rotate. Rotatable shaft 32 rotates impeller 46 to effect pumping of the liquid within pump 10. Can 37 can be formed of a nonmetallic material so as to prevent eddy currents from being generated during use, thereby reducing power requirements and reducing generated heat. Cooling ducts 9 can be provided for passage of heat exchange liquid through the stationary housing 35 to assist in cooling the pump 10 during use.

In order to cool the wear end, pressurized gas enters through inlet 18A and pressurizes all areas internal to housing section (can) 12 and housing 54. The gas provides and assists seal 50 and 52 to separate from each other so as to pump gas into upstream zone X. This effects cooling and lubrication of the faces of seals 50-52 and prevents liquid being pumped from entering the wear end. The gas also cools bearings such as antifriction bearings 13, 15 and 21. Gas pressurized externally from the pump 10 also can be employed.

An internal pump is formed of a stationary ring 50 and a rotatable ring 52. Stationary ring 50 is secured to section 54 of stationary housing section 12. Rotatable ring 52 is fixed to rotatable shaft 32 and is positioned in contact with fixed ring 50. Alternatively, rotatable ring 52 can be mounted on impeller 46. During rotation, lubricating gas passes from zone 19 to zone 64. When the ring 52 is stationary, the rings 50 and 52 contact each other to form a seal. As shown in FIGS. 2 and 3, in one embodiment, rotatable ring 52 includes slots 58 and surfaces 60. The surfaces 60 contact stationary ring 50. Ring 52 is rotated in the direction of arrow 56 in order to pump gas through the slots 58 in the direction of arrow 66. The slots 58 typically have a depth of about 0.0001 to 0.0003 inch which permits pumping of only small amounts of lubricating gas from zone 19 into zone 64 and then through outlet 20. It is to be understood that this invention can be utilized with any rotatable sealless pump.

Referring to FIGS. 1A, 2, 3, 4 and 4A, a canned pump 11 includes a stationary housing formed of a wear end housing section 12 and a pump end housing section 14 which are joined together by bolts. The pump 11 includes a fluid inlet 18 and a fluid outlet 20. The pump 11 comprises a rotatable shaft 32 to which is attached a rotor 31, positioned within windings 33. The stationary housing 37 seals annular spaces 17 as well as rotor 31 from the windings 33. The stationary housing 37 can be formed of a nonmetallic material. The stationary housing 37 includes an inlet 18A and an outlet 20A so that gas can be pumped through annular spaces 17 and 19. Repeller 23 is provided with vanes 25. Impeller 46 is provided with vent holes 27. Rotatable shaft 32 rotates impeller 46 to effect pumping of the liquid within pump 11. Liquid 8 is prevented by gas 7 from entering housing 37.

An internal pump is formed of a stationary ring 50 and a rotatable ring 52. Stationary ring 50 is secured to section 54 of stationary housing section 12. Rotatable ring 52 is fixed to rotatable shaft 32 and is positioned in contact with fixed ring 50. As shown in FIGS. 2 and 3, rotatable ring 52 includes slots 58 and surfaces 60. The surfaces 60 contact stationary ring 50. Ring 52 is rotated in the direction of arrow 56 in order to pump gas through the slots 58 in the direction of arrow 66. The slots 58 typically have a depth of about 0.0001 to 0.0003 inch which permits pumping of only small amounts of lubricating gas from zone 19 into zone 64 and then through outlet 20.

Figure 13:
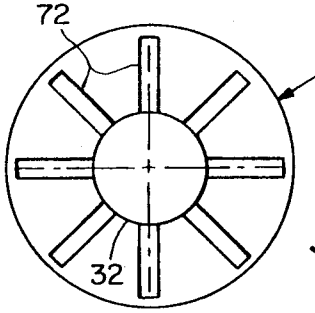
FIG. 13 is a front view of an alternative rotatable ring of an internal pump useful in this invention.
Figure 5:
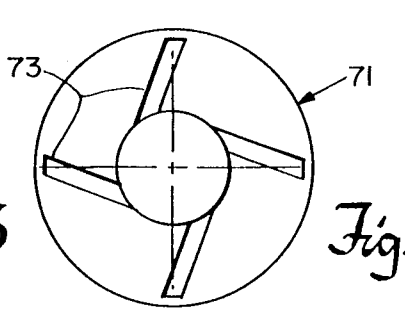
FIG. 5 is a front view of an alternative rotatable ring of an internal pump useful in this invention.
Figure 6:
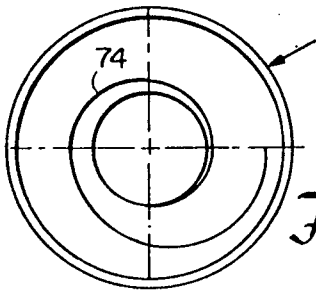
FIG. 6 is a front view of an alternative rotatable ring of an internal pump useful in this invention.
Figure 7:
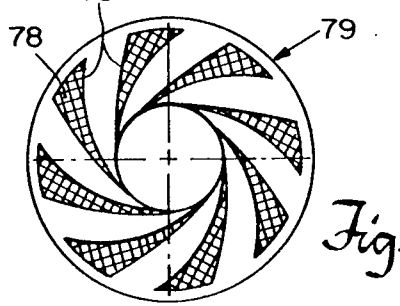
FIG. 7 is a front view of an alternative rotatable ring of an internal pump useful in this invention.
Figure 12:
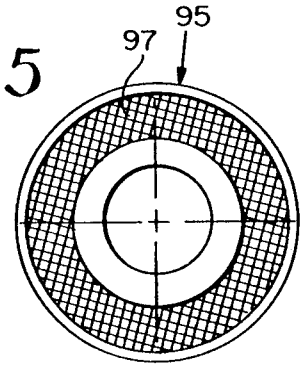
FIG. 12 is a front view of an alternative rotatable ring of an internal pump useful in this invention.

Referring to FIGS. 5–7, 12 and 13, alternative rotatable rings are shown which contact a stationary ring having a flat surface and function as described above with reference to FIGS. 2 and 3. As shown in FIG. 13, the rotatable ring 71 includes a plurality of angled slots 73. As shown in FIG. 6, a spiral shaped slot 74 is utilized on the rotatable ring 75. As shown in FIG. 7, sail shaped slots 76 having a plurality of pockets 78 is utilized on rotatable ring 79. As shown in FIG. 12, the rotatable ring 95 includes a ring shaped indentation 97. As shown in FIG. 13, a rotatable ring 70 is positioned on shaft 32. A plurality of slots 72 extend from the shaft 32.

Figure 4:
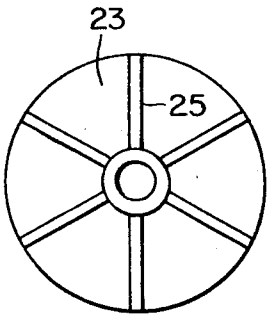
FIG. 4 is a front view of a repeller taken along line 4—4 of FIG. 1A.
Figure 4A:
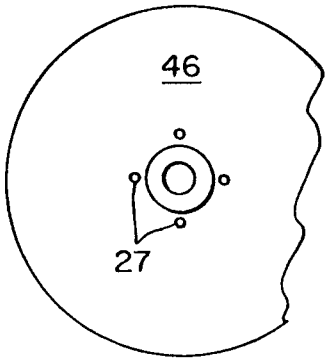
FIG. 4A is a front view of an impeller taken along line 4A—4A of FIG. 1A.
Figure 8:
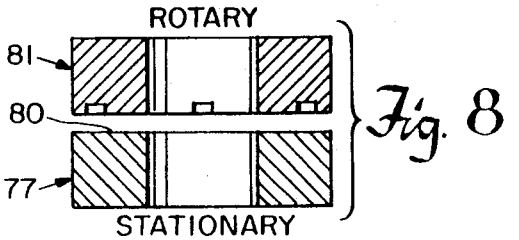
FIG. 8 is a front view of an alternative rotatable ring of an internal pump useful in this invention.
Figure 9:
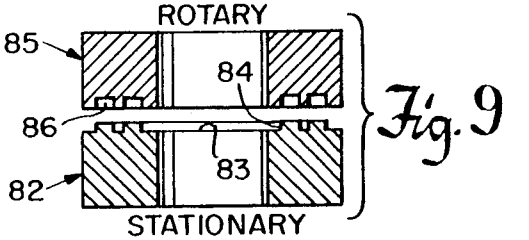
FIG. 9 is a front view of an alternative rotatable ring of an internal pump useful in this invention.
Figure 10:
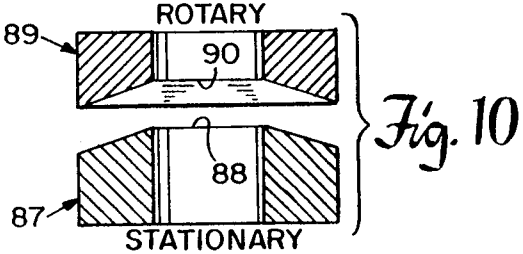
FIG. 10 is a front view of an alternative rotatable ring of an internal pump useful in this invention.
Figure 11:
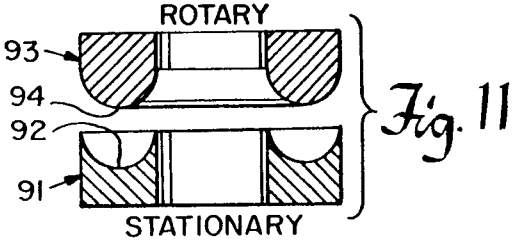
FIG. 11 is a front view of an alternative rotatable ring of an internal pump useful in this invention.

Referring to FIGS. 8–11, arrangments of a rotatable ring and a stationary ring are shown wherein the stationary ring has a non-flat or flat surface. As shown in FIG. 8, the stationary ring 77 has a flat surface 80 and rotatable ring 81 has indentations such as are shown in FIGS. 2, 4 and 5. As shown in FIG. 9, stationary ring 82 has a surface 83 with a labyrinth 84 while rotatable ring 85 has a mating labyrinth 86. AS shown in FIG. 10, stationary ring 87 has a raised central surface 88 while rotatable ring 89 has a mating indented surface 90. As shown in FIG. 11, stationary ring 91 has a surface with a circular indentation 92 while rotatable ring 93 has a mating surface 94. Other suitable arrangements of a rotatable ring and a stationary ring are disclosed in U.S. Pat. Nos. 4,290,611 and 5,090,712 which are incorporated herein by reference.

Figure 14:
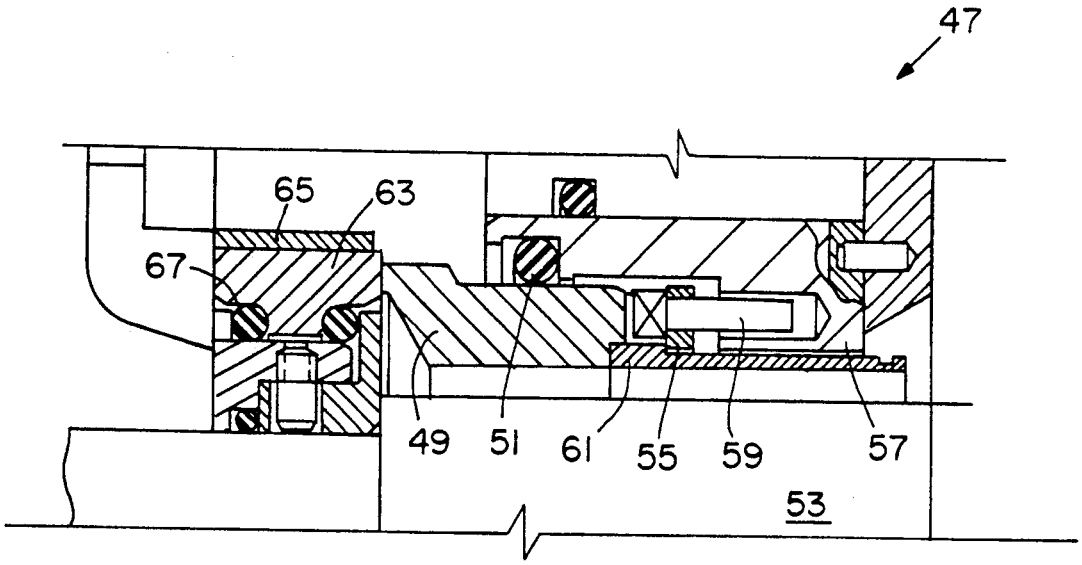
FIG. 14 is a one-half cross-sectional view of an alternative internal pump useful in this invention.

Referring to FIG. 14, an alternative internal pump useful in the present invention is shown. The internal pump 47 includes a stationary ring comprising an inclined seal face 49, an O ring 51, rotatable shaft 53, a thrust ring 55, a stationary housing 57, a pin 59 and a sleeve 61. The rotating ring 63 mounted on shaft 53 comprises a rotating face in contact with the flat portion of face 59 which is flat, a shrunk in ring 65 and an O ring 67. When rotation is effected, lubricating gas passes between stationary face 49 and rotating face 63, Examples of these types of internal pumps are available from Burgmann Seals America, Inc., Houston, Tex. and identified as their HR series and from Durometallic Corporation, Kalamazoo, Mich. and identified as the SL-Series Dura Seal.

Figure 15:
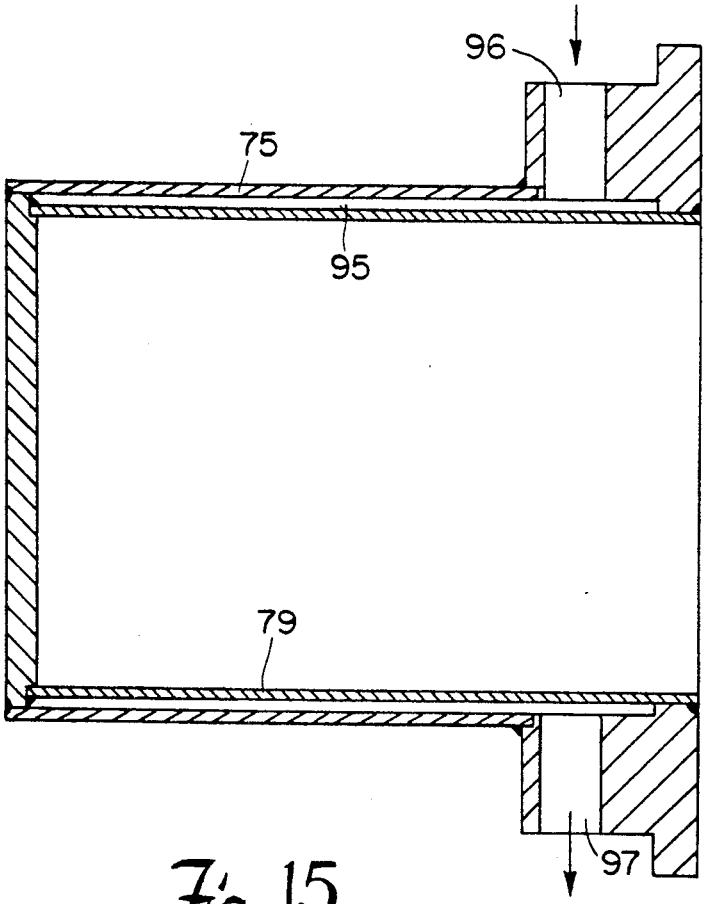
FIG. 15 is a cross-sectional view of an alternative can construction shown in the pump of FIGS. 1 and 1A.

Referring to FIG. 15, a dual can construction suitable for use in this invention includes dual walls 75 and 79 separated from each other to form a cylindrical space 95. A cooling liquid or gas can be introduced into inlet 96, into space 95 and outlet 97. This cooling means can be utilized to supplement the cooling means described above. The dual can construction can be formed of metal or nonmetal.

The pumps of this invention provide substantial advantages over prior art sealless pumps comprising canned motor pumps or magnetic drive pumps. By the use of a barrier gas under conditions wherein the pumped fluid is excluded from the wear end of the pump, any pumped fluid regardless of chemical or physical characteristics can be pumped so long as degradation of the pump end is not effected. Thus, liquid detrimental to the wear end, slurried or high temperature fluids can be processed without wear to the wear end. In addition, nonmetallic cans, i.e., seals between the stator and rotor sections at the wear end of the pump can be formed of nonmetallic compositions. Thus losses due to eddy currents can be avoided thereby improving energy and cooling efficiencies substantially. In addition, the present invention permits the use of antifriction bearings.

We claim:

1. A pump comprising a rotatable shaft mounted in a wear end of said pump, said wear end including a rotor, means for effecting rotation of said rotor and said shaft and a housing seal between said means for effecting rotation and said rotor, a pump means mounted on said rotatable shaft in a pump end of said pump, means for introducing a liquid into said pump end, means for removing said liquid from said pump end, means for introducing pressurized gas into said wear end, an internal pump positioned between said pump end and said wear end on said rotatable shaft, said internal pump comprising a rotatable ring connected to said shaft and having a first face contacting a second face on a stationary ring, said first face and second face having a surface configuration which effects transfer of said gas in said wear end to said pump end while preventing said liquid in said pump end from entering said wear end when said shaft is rotated and said internal pump sealing said wear end from said pump end when said shaft is not rotated.

2. The pump of claim 1 wherein said first face includes an inclined surface.

3. The pump of claim 1 wherein said pump means comprises an impeller mounted on said rotatable shaft.

4. The pump of claim 1 wherein said first face includes indentations.

5. The pump of claim 4 wherein said pump means comprises an impeller mounted on said rotatable shaft.

6. The pump of claim 1 wherein said means for effecting rotation of said rotor and said shaft comprises windings.

7. The pump of claim 1 wherein said rotor comprises rotatable magnet means.

8. The pump of claim 1 wherein said means for effecting rotation of said rotor and said shaft comprises rotating magnet means.

9. The pump of claim 8 wherein said rotor comprises a rotatable torque ring.

10. The pump of any one of claims 1, 8, 6, 7 or 9 wherein said gas is air.

11. The pump of any one of claims 1, 8, 6, 7 or 9 which includes an impeller on said rotor.

12. The pump of any one of claims 1, 8, 6, 7 or 9 which includes means for passing a heat exchange fluid through a stationary housing for said pump.

13. The pump of claims 1, 8, 6, 7 or 9 wherein said rotatable ring is connected directly on said shaft.

14. The pump of any one of claims 1, 8, 6, 7 or 9 wherein said rotatable ring is connected on rotatable mounting means, said rotatable mounting means being mounted on said shaft.

15. The pump of any one of claims 1, 8, 6, 7 or 9 wherein said gas is nitrogen.

16. The pump of any one of claims 1, 8, 6, 7 or 9 wherein said rotatable shaft in said wear end is mounted on antifriction bearing means.

* * * * *